US006209170B1

(12) United States Patent
Huynh

(10) Patent No.: US 6,209,170 B1
(45) Date of Patent: Apr. 3, 2001

(54) DOOR KNOB BUMPER AND RETAINER

(76) Inventor: Son Van Huynh, 1242 Remington Rd., Schaumburg, IL (US) 60173

( * ) Notice: Subject to any disclaimer, the term of this patent is extended or adjusted under 35 U.S.C. 154(b) by 0 days.

(21) Appl. No.: 09/190,080

(22) Filed: Nov. 12, 1998

Related U.S. Application Data

(60) Provisional application No. 60/065,733, filed on Nov. 14, 1997, and provisional application No. 60/094,700, filed on Jul. 30, 1998.

(51) Int. Cl.[7] ..... E05F 5/06
(52) U.S. Cl. ..... 16/86 A; 16/86 R
(58) Field of Search ..... 16/86 R, 86 A, 16/2

(56) References Cited

U.S. PATENT DOCUMENTS

| | | | | |
|---|---|---|---|---|
| 878,864 | | 2/1908 | Buschur . | |
| 1,085,027 | | 1/1914 | Downey . | |
| 1,128,173 | | 2/1915 | Miller . | |
| 1,431,040 | | 10/1922 | Rawlings . | |
| 1,889,681 | * | 11/1932 | Marshall | 16/82 |
| 2,289,873 | * | 4/1942 | Claude-Mantle | 16/82 |
| 2,530,365 | | 11/1950 | Johnson et al. | 292/17 |
| 3,055,689 | | 9/1962 | Jorgensen | 292/70 |
| 4,159,837 | | 7/1979 | Morita | 292/127 |
| 4,951,984 | | 8/1990 | Huang | 292/76 |

* cited by examiner

*Primary Examiner*—Anthony Knight
*Assistant Examiner*—Enoch E. Peavey
(74) *Attorney, Agent, or Firm*—Lee, Mann, Smith, McWilliams, Sweeney & Ohlson

(57) ABSTRACT

A resilient door knob bumper receives a door knob in an aperture, the deformation of the resilient bumper retaining the door knob in position in the aperture.

11 Claims, 3 Drawing Sheets

DOOR KNOB BUMPER AND RETAINER

CLAIM OF PRIORITY

This application claims priority based on Provisional Application Ser. No. 60/065,733 filed Nov. 14, 1997 and Provisional Application Ser. No. 60/094,700, filed Jul. 30, 1998.

BACKGROUND OF THE INVENTION

This invention relates to a door knob bumper and retainer which is designed to prevent the door knob of a door from damaging the wall and to retain the door knob so that the door is held open. The door knob bumper and retainer of this invention functions without any mechanical parts, is simple to install and is reliable to maintain a door in an open condition and protect the wall.

BRIEF SUMMARY OF THE INVENTION

Almost all doors which swing on hinges have door knobs of one type or another. The door knob may be of a cylindrical nature, it may be of an elongated nature, but in any event, all door knobs function similarly in that they are used by turning to open doors. Unfortunately, when the doors open, the door knobs frequently meet a wall adjacent the door opening and this meeting can cause damage to the wall. Furthermore, doors have a tendency to swing shut as a result of the location of hinges, air movements and the like all of which can be very frustrating. It is an object of this invention to provide a door knob bumper and retainer which both retains the door knob, so that the door is held open, and at the same time protects the wall from damage from the door knob. When the words door knob are used in this provisional application, it is intended that those words cover door knobs of cylindrical shape as well as elongated door handles and the like. Mechanical door knob catches are known in the art and have been used to retain doors in an open condition.

Mechanical door knob retainers generally include a unit which will hook the door knob in some fashion after being activated by the door knob striking the unit. For example, U.S. Pat. No. 4,951,984 to Huang issued Aug. 28, 1990 is designed to retain a door knob and uses an elastic hook member. Another reference which discloses a door knob retainer is U.S. Pat. No. 1,085,027 issued to Downey on Jan. 20, 1914 which puts a door check on the opposite side of the door from the door knob and includes a cam arrangement on a piston which absorbs the energy of a slamming door pneumatically. Neither of these references disclose an invention in any way similar to that of applicant's door knob bumper and retainer way simi

BRIEF DESCRIPTION OF THE DRAWINGS

Provided herewith is a drawing prepared by the inventor which includes.

DETAILED DESCRIPTION OF THE INVENTION

Figure 1:
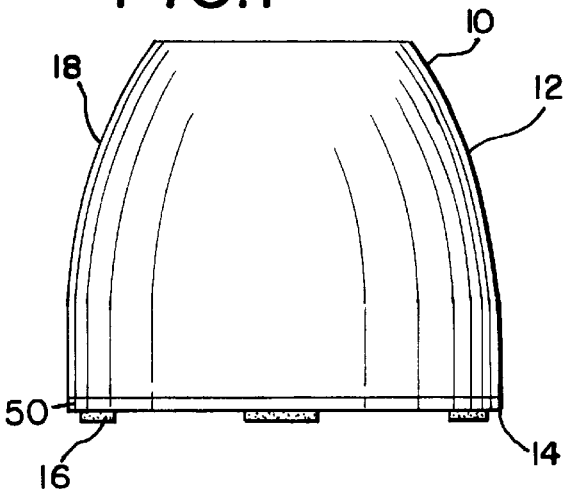
FIG. 1 which is an elevational view of the door knob bumper and retainer of this invention.
Figure 2:
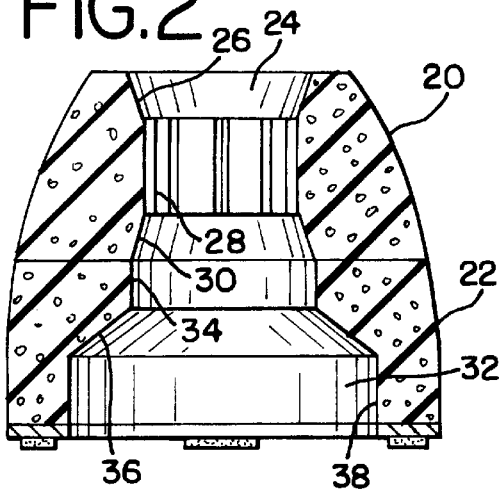
FIG. 2 is a sectional view through the door knob bumper shown in FIG. 1.
Figure 3:
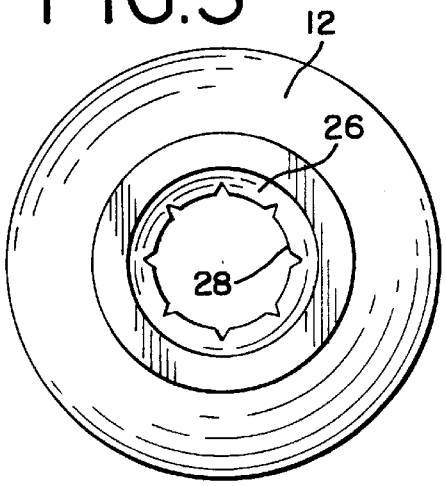
FIG. 3 is a top plan view of the door knob bumper shown in FIG. 1
Figure 4:
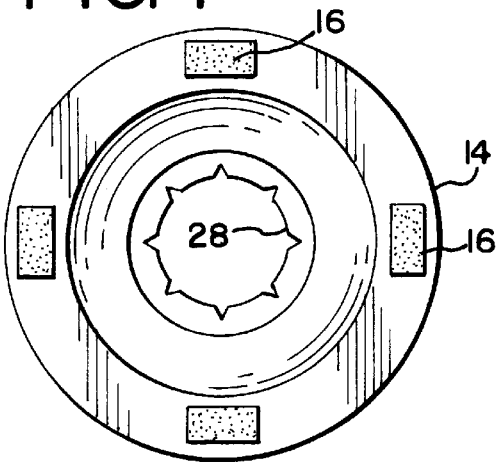
FIG. 4 is a bottom plan view of the door knob bumper shown in FIG. 1 showing the inner retainer section.
Figure 5:
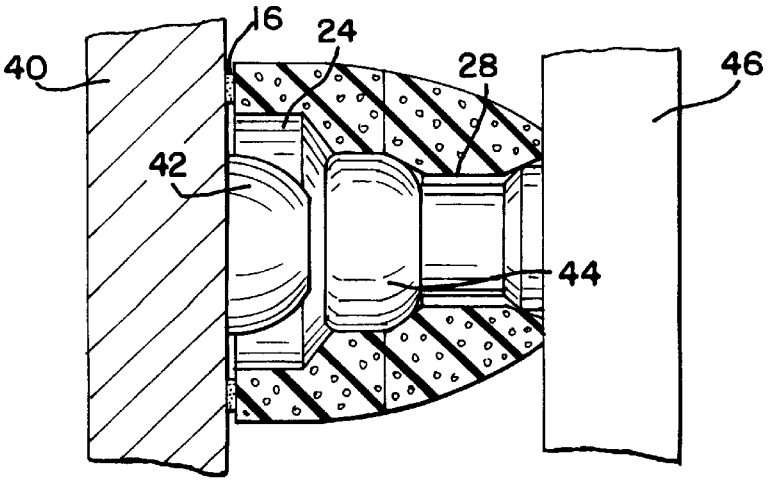
FIG. 5 is a sectional view showing how a door knob is gripped in the door knob bumper and retainer of this invention.

Referring specifically to FIGS. 1 through 5, the door knob retainer 10 has a body portion 12 affixed to a base 14. On the bottom of the base 14 are preferably adhesive fasteners 16. The exterior body 10 has a curved symmetrical surface 18.

Body 12 comprises a resilient elastomeric material which may be a flexible urethane foam or any other foam material which is flexible in nature made by suitable processes so long as the resilient foam material can be used. Foam rubber is another example of this type of material. In the prototype shown in the drawings, a top segment 20 is bonded to a lower segment 22. This enables some level of ease in manufacturing the recess 24 which will be described in more detail. It should be understood, however, that the unit can be molded in one piece. Recess 24 has a beveled entry wall, a fluted resilient portion 28, a beveled gripper wall 30 which leads to a retaining chamber 32. Elements 26, 28 and 30 are formed in the top segment 20. Chamber 32 has a cylindrical wall 34 which merges into a clearance beveled wall 36 and vents into a cylindrical enlarge clearance wall 38. In operation, fasteners 16 are affixed to wall 40.

Clearance wall 38 enables the retrofitting of the bumper 10 on a wall 40 that already has a standard door knob bumper 42 in place. In operation, door knob 44 affixed to door 46 passes through chamber 24 extending wall 28 to grip knob 44, thereby preventing door 46 from accidental closure. Bevel walls 26–30 ease passage of knob 44 into and out of retainer 10. The contact of retainer 10 with door 44 provides an auxiliary bumper function as well as to protect the wall.

The door bumper of FIGS. 1–5 captures the door knob in chamber 32 after the knob passes wall 30. The embodiment in FIGS. 6–9 uses the resiliency of the body itself to capture the knob, the first version is retrofittable over an existing bumper. The second version is more compact and more economical to form. While the second embodiment and first embodiment are adapted to use of a plate 50 on base 14, a sufficiently rigid coating could be formed directly on the base, which would provide economies and greater all around resiliency, particularly when used with an appropriate adhesive coating.

As shown in FIGS. 6, 7, 8, and 9, the door knob bumper and retainer of this invention is preferably molded in one piece such as shown in FIGS. 6, 7, 13 and 14. The two pieces of the original embodiment (FIGS. 1–5) would use easier to make tooling than a one piece version that also has the multiple diameter section of the chamber 32 of that first embodiment. In the preferred one piece embodiment, the operation of the bumper is substantially the same.

Figure 6:
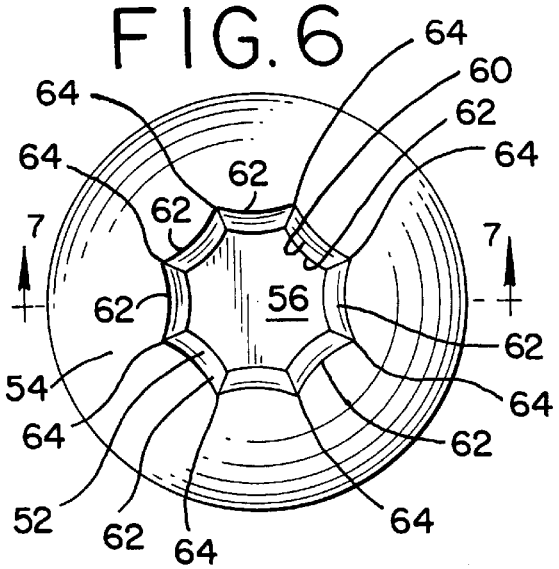
FIG. 6 is a top plan view of the interior of the preferred embodiment of a door knob bumper and retainer of this invention.
Figure 8:
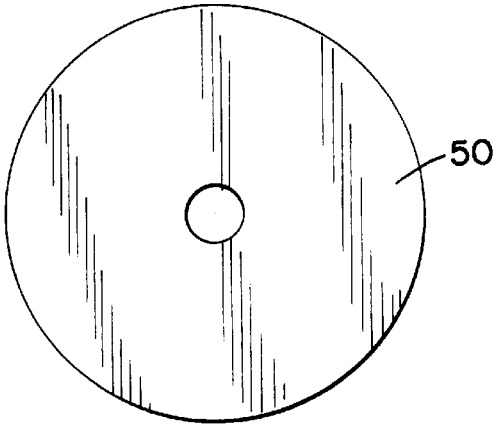
FIG. 8 is a bottom plan view of the preferred door knob bumper of this invention.
Figure 7:
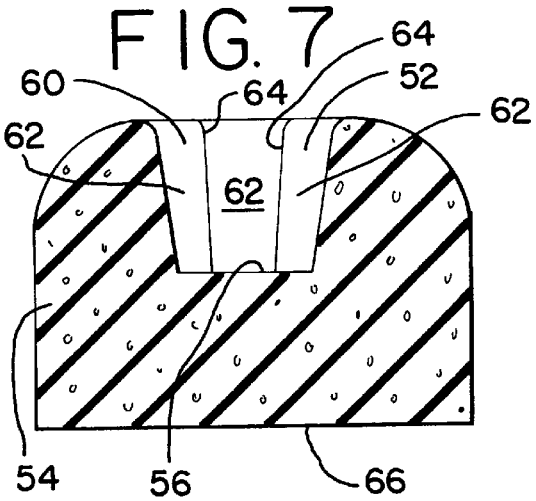
FIG. 7 is a sectional side view of the preferred door knob bumper and retainer of this invention.
Figure 9:
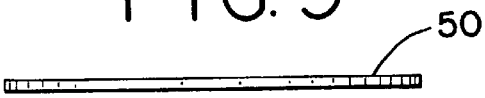
FIG. 9 is a side view of the rear plate of the door knob bumper of this invention.

In the version in FIGS. 6–7, the knob would be retained in the opening 52 formed in the bumper body 54. A bottom wall 56 protects the wall on which the bumper is mounted. In the structure shown in FIG. 8, there is no provision for retrofitting over a previously installed door bumper as in the first embodiment. The function of the preexisting bumper is performed by wall 56. Opening 52 has a continuous gripper wall, generally 60, which includes both curved segments 62 and grooved portions 64 where the segments 62 merge with one another. The base 66 rear plate of the invention is either directly attached to the wall by adhesives or is attached to plate 50, which is itself attached to the wall, or a combination, as by mechanical fastening of the plate 50 and adhesive fastening of the base 66 to the plate 50. This latter may be more useful in situations where the wall finish is not suitable to adhesive fastening, such as certain laminations, paints or wallpaper.

Figure 10:
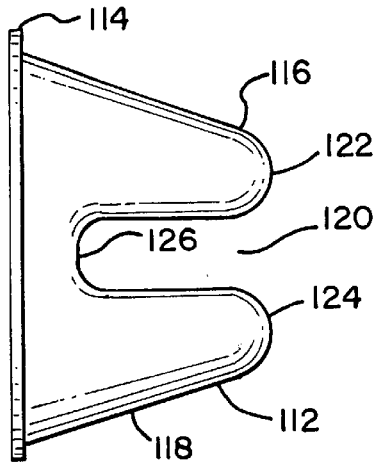
FIG. 10 is a side view of an alternative embodiment of the invention in its operative position.
Figure 11:
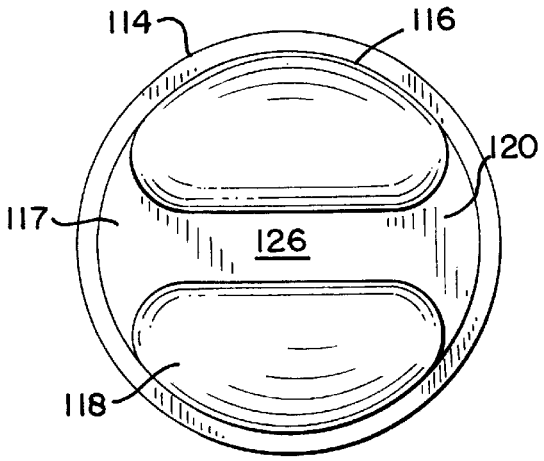
FIG. 11 is a front elevational view of an alternative embodiment of the invention in its operative position.
Figure 12:
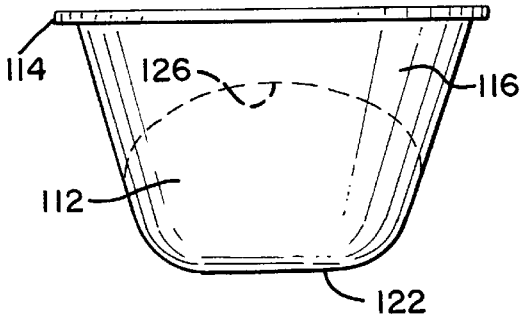
FIG. 12 is a top plan view of an alternative embodiment of the invention in its operative position.

An alternative embodiment in FIGS. 10–12 discloses a door bumper adapted to receive handle-type door latch actuators. Unlike knobs, which are symmetric or substantially symmetric because of their generally circular configurations, handles extend along an axis. Thus, the bumper 112 is slotted to permit retention of a handle. More particularly, a backing plate 114 may be used that supports bumper 112 having an upper lobe 116 and a lower lobe 118 defining a slot 120 therebetween. Upper end 122 and lower end 124 contact the door, while slot saddle portion 126 can absorb contact from the handle.

Figure 13:
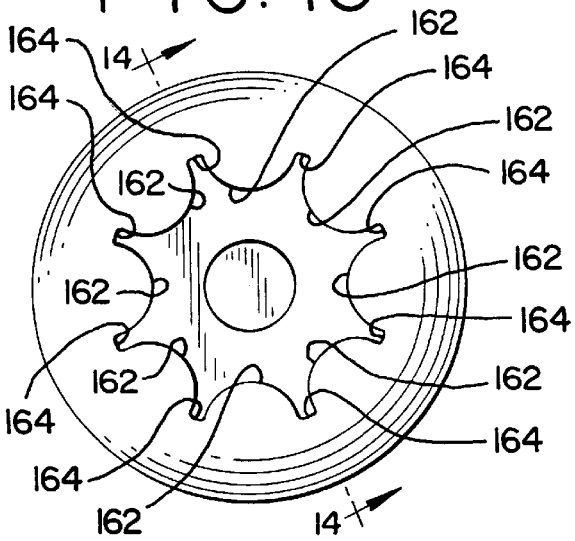
FIG. 13 is a front elevational view of the interior of a slightly alternate door knob bumper and retainer of this invention.
Figure 14:
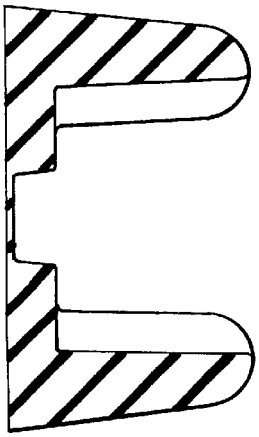
FIG. 14 is a sectional view of the alternate door knob bumper and retainer of this invention of FIG. 13.

FIG. 13 and FIG. 14 show the most preferred configuration of the one piece embodiment. These show deeper flutes than the segments 62 and grooved portions 64 of FIGS. 6–7. In these views wall segments 162 join crenellated groove portions l64. It will be observed that this provides deeper grooving than the FIGS. 6–7 embodiment owing to the greater curvature of wall segments 162 and separation provided by crenellated groove portions 164. In section, curved wall segments 162 are nearly semicircular, extending about 130 degrees while the gentle curve of segments 62 extends over only about 30 degrees. While 130 degrees is shown, a substantial curvature, up to slightly less than 180 degrees could be used.

It is believed that this application completely discloses applicant's invention in a door knob bumper and retainer such that one skilled in the art could readily manufacture such an item and make reasonable adjustments in the structure to accommodate different size door knobs.

I claim:

1. A door bumper for retaining a door comprising:

a base;

a resilient body affixed to the base;

said body being formed to define a doorknob receiving recess, whereby the door knob can be retained in position by the action of the resilient body.

said recess having an entry wall;

said entry wall leading to a gripper wall;

said gripper wall leading to a retaining chamber;

said base and said recess having an enlarged clearance wall defining a clearance opening whereby said bumper base can be attached to a building wall on which is mounted a preexisting nonretaining door bumper;

said gripper wall being formed as a fluted wall.

2. The bumper of claim 1 further comprising:

said retaining chamber being defined in the portion of said fluted wall closest to said base;

said gripper wall being of substantially constant diameter along its length when said bumper is empty of a doorknob;

said retaining chamber resiliently conforming to the shape of a doorknob retained therein.

3. The bumper of claim 1 further comprising:

said recess entry wall being a first entry wall and said bumper having a second entry wall substantially opposed to said first entry wall;

said gripper wall being a first gripper wall;

said second entry wall leading to a second gripper wall;

said retaining chamber being of slot-like configuration adapted to receive a door handle.

4. A door bumper for retaining a door comprising:

a base;

a resilient body affixed to the base;

said body being formed to define a doorknob receiving recess, whereby the door knob can be retained in position by the action of the resilient body;

said recess having an entry wall;

said entry wall leading to a gripper wall;

said gripper wall leading to a retaining chamber;

said base and said recess having an enlarged clearance wall defining a clearance opening whereby said bumper base can be attached to a building wall on which is mounted a preexisting nonretaining door bumper;

said griper wall being formed as a fluted wall;

said fluted wall being formed of a plurality of wall segments;

said wall segments being joined by a plurality of groove portions so as to continuously form said fluted wall from said segments and portions.

5. The bumper of claim 4 further comprising:

said wall segments being formed of convexly curved surfaces extending from between 15 to less than 180 degrees.

6. The bumper of claim 4 further comprising:

said wall segments being formed of convexly curved surfaces extending substantially 130 degrees between said groove portions.

7. A door bumper for retaining a door comprising:

base means for mounting said bumper to a building wall;

resilient body means for bumping and retaining a doorknob, said body means being affixed to said base means;

said body means being formed to define recess means for receiving a door knob whereby the door knob can be retained in position by the action of the resilient body;

said recess means having entry wall means for entry of a door knob;

said entry wall means leading to gripping means for gripping the door knob;

said gripping means leading to a retaining means for retaining the doorknob and holding the door in a selected position;

said gripping means being formed as a fluted wall.

8. The bumper of claim 7 further comprising:

said retaining means for retaining being defined in the portion of said fluted wall closest to said base;

said gripping means being of substantially constant diameter along its length when said bumper is empty of a doorknob;

said retaining means resiliently conforming to the shape of a doorknob retained therein.

9. The bumper of claim 7 further comprising:

said fluted wall being formed of a plurality of wall segments;

said wall segments being joined by a plurality of groove portions so as to continuously form said fluted wall from said segments and portions.

10. The bumper of claim 9 further comprising:

said wall segments being formed of convexly curved surfaces extending from between 15 to less than 180 degrees.

11. The bumper of claim 9 further comprising:

said wall segments being formed of convexly curved surfaces extending substantially 130 degrees between said groove portions.

* * * * *